US005439707A

United States Patent [19]

Nelli et al.

[11] Patent Number: 5,439,707

[45] Date of Patent: Aug. 8, 1995

[54] COATING FORMULATION AND METHOD OF PRODUCTION THEREOF FOR POST PRINT WAXABLE LINERBOARD

[75] Inventors: Leo M. Nelli, Wallkill; Eitan Avni; Lori Slovik, both of Monroe; Kevin Ellis, Washingtonville, all of N.Y.

[73] Assignee: International Paper Company, Tuxedo Park, N.Y.

[21] Appl. No.: 238,402

[22] Filed: May 5, 1994

[51] Int. Cl.[6] ..... B05D 1/36; B05D 5/00

[52] U.S. Cl. ..... 427/258; 427/265; 524/413; 524/425; 524/445

[58] Field of Search ..... 427/258, 288, 391, 265; 524/413, 425, 445

[56] References Cited

U.S. PATENT DOCUMENTS

| | | | |
|---|---|---|---|
| 4,282,059 | 8/1981 | Davidson | 162/158 |
| 4,440,827 | 4/1984 | Miyamoto et al. | 428/327 |
| 4,474,920 | 10/1984 | Kyminas et al. | 524/386 |
| 4,478,910 | 10/1984 | Oshima et al. | 428/331 |
| 4,758,461 | 7/1988 | Akiya et al. | 428/212 |
| 4,812,299 | 3/1989 | Wason | 423/328 |
| 4,830,911 | 5/1989 | Kojima et al. | 428/342 |
| 4,863,796 | 9/1989 | Wason | 428/331 |
| 4,888,378 | 12/1989 | Kostiako | 524/450 |
| 4,892,591 | 1/1990 | Ogawa et al. | 106/482 |
| 4,910,084 | 3/1990 | Yamasaki et al. | 428/411.1 |
| 4,915,923 | 4/1990 | Ogawa et al. | 423/335 |
| 4,988,561 | 1/1991 | Wason | 428/331 |
| 5,013,603 | 5/1991 | Ogawa et al. | 428/331 |
| 5,127,995 | 7/1992 | Wason | 162/181.6 |
| 5,169,441 | 12/1992 | lauzon | 106/416 |
| 5,171,365 | 12/1992 | Wason | 106/632 |
| 5,302,404 | 4/1994 | Rissanen et al. | 428/46 X |

FOREIGN PATENT DOCUMENTS

| | | |
|---|---|---|
| 1513047 | 6/1978 | United Kingdom . |

*Primary Examiner*—Michael Lusignan

*Attorney, Agent, or Firm*—Stewart L. Gitler; Michael J. Doyle; Paul R. Juhasz

[57] ABSTRACT

Coating formulations, unique methods for their production and use, which have high drying capacity, maintain high levels of brightness, even after the application of a wax coating onto the printed substrate. Precipitated amorphous silicates, titanium dioxide, and other fillers are combined and coated onto heavyweight linerboard to facilitate ink drying and minimize brightness loss associated with wax dipped cartons.

10 Claims, No Drawings

COATING FORMULATION AND METHOD OF PRODUCTION THEREOF FOR POST PRINT WAXABLE LINERBOARD

BACKGROUND OF THE INVENTION

This invention relates to the production of an unique highly absorbent coating formulation, and its use to facilitate multi-color flexographic printing onto linerboard. Heavyweight linerboard is coated, printed upon, dipped into wax and converted into a carton for various packaging applications. A need has arisen for a highly absorbent coating for heavyweight linerboard which is compatible with high quality multi-color printing inks, thereby allowing the printing inks to dry quickly and maintain a high percentage of brightness even after waxing.

High water absorbency is required to aid in the ink drying process on a post print flexographic press. Post print flexographic presses do not ordinarily incorporate driers to cure the ink film during printing. Multi-color graphics require ink to dry rapidly, enabling additional layers of colored inks to be rapidly applied to the substrate maintaining print clarity and uniformity. The highly absorbent nature of the coating formulation solves the ink drying problem by rapidly absorbing the water from the colored ink. In addition, the unique formulation enables the multi-color high quality flexographic ink to maintain a high level of brightness after the converted carton has been coated with wax.

British patent No. 1,513,047 relates to a process for the production of coated lightweight paper with improved printing. The patent addresses lightweight papers which are used as printing supports for journals and cover pages of most magazines. The lightweight paper is said to have a weight range of 45 g/m$^2$ to 100 g/m$^2$. Disclosed is a thin coating for a lightweight paper wherein both sides of the paper is coated with a precipitated amorphous silicate. The two sided coating, embodying the disclosure, exhibits an increased elastic volume in the coating layers. The coated lightweight paper is then glazed on a calendar, eleven times, under a steady linear pressure. The resultant two-side coated lightweight glazed paper is now suitable for gravure or offset printing.

In contrast, the present invention provides an unique process for producing an unique formulation for enhancing multi-color flexographic printing for application to heavyweight linerboard. The linerboard, embodying the invention, has a basis weight greater than 150 g/m$^2$. The linerboard is only coated on its gloss side to facilitate flexographic printing of multi-color inks and subsequent post print wax dipping. The thick coating formulation absorbs the water from the ink and allows for successive layers to be rapidly printed thereon.

In addition, British Patent No. 1,513,047 mentions that the synthetic amorphous silicate component embodying its coating is dispersed in the coating formulation with moderate stirring in the absence of high shear stressing. Applicant specifically incorporates the amorphous silicate into the coating formulation at high shear to facilitate formation of the formulation.

The linerboard coating embodying the present invention has an unique functionality for it intended product use.

In the post print process, successive layers of a pigment based aqueous ink are printed onto a containerboard. The containerboard is a conjugated multi-component structure made up of a fluted material known as a medium which is bonded on each side of the flute tips to linerboards. Without use of the unique coating formulation, embodied by the present invention, a specific drying step or method would be required after the deposition of each ink layer during flexographic printing. Such requirement would be economically prohibitive and slow the overall process. The process by which the ink is applied to the coated linerboard is flexography. In this printing process, an inductor roll is used to transfer ink from the ink pen to an anilox roll. The anilox roll is made up of a multitude of cells designed to contain a precise volume of ink. The ink is then transferred to a printing plate which deposits that volume of ink to the substrate. Multiple colors of ink would be applied to the coating. It is essential that the ink be dry prior to an additional application of ink. One function of the coating formulation is to absorb the inks liquid phase to effect drying. Silica and silicate products have been known to accomplish this via absorption.

Further, it is an objective of the present invention to produce a coating formulation that can maintain the brightness of an ink even after a wax coating has been applied to a converted carton.

It is a further object of the invention to improve print uniformity and quality of multi-color graphics in flexographic printing onto a heavyweight linerboard substrate.

DETAILED DESCRIPTION OF THE INVENTION

The present invention involves an uniquely produced coating formulation. The coating formulation has high water absorbency to aid in the ink drying process on a post print flexographic press. Post print flexographic presses do not incorporate driers to cure the ink during and between multi-color ink application onto a heavyweight linerboard substrate. The linerboard substrate has a basis weight greater than 150 g/m$^2$ and, as such, requires a thick coating prior to printing. The linerboard is coated on one side prior to multi-color graphic printing. The unique coating formulation is applied in a thickness of from 19.5 g/m$^2$ to 40.9 g/m$^2$. The unique coating formulation is prepared by combining 5 parts of a suitable clay constituent such as number 2 clay; 55 parts of a ground calcium carbonate; 20 parts titanium dioxide; and if desired, an additive amount of a dispersant such as hexametaphosphate (less than 1%) in a vat to form an initial slurry. To the initial slurry there is added one-half of the required amount of a precipitated amorphous silicate (10 parts) and a latex binder (23 parts) such as polyvinyl acetate. The initial addition of precipitated amorphous silicate is added to the slurry under high shear stress to facilitate dispersion. Finally, there is added to the vat the remaining one-half component of precipitated amorphous silicate (10 parts). This final addition takes place under high shear to produce an unique slurry coating formulation which possesses a total solids content of 58%. The formulation contains the constituents in the following proportions by weight: 0–80% clay; 0–80% calcium carbonate; 10–40% titanium dioxide; 10–30% precipitated amorphous silicate; and 10–40% latex binder.

A preferred coating formulation composition includes approximately: 4% number 2 clay; 47% ground calcium carbonate; 15% titanium dioxide; 15% precipitated amorphous silicate; 18% polyvinyl acetate and 1% or less of hexametaphosphate.

The uniquely prepared formulation is coated onto a linerboard substrate to facilitate flexographic multi-color printing on the board. As ink layers are applied to the coated board, water is absorbed into the coating, thereby accelerating the drying process allowing for successive layers of ink to be rapidly printed thereon resulting in an uniform multi-color graphic presentation. Additionally, the coating substantially maintains the brightness of the multi-color graphic even after wax has been coated over the ink. No waxable post printable coating for linerboard presently exists which provides the drying capacity and waxability of the uniquely prepared coating formulation embodying the invention.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for producing a highly absorbent coating formulation for facilitating multi-color printing onto a linerboard substrate having a basis weight greater than 150 g/m$^2$ comprising the steps of:

a) combining clay, calcium carbonate, titanium dioxide and an additive amount of hexametaphosphate in a vat to form a first mixture;

b) adding one-half of an amount of a precipitated amorphous silicate, and a latex binder to said vat under shear stresses to form a second mixture; and c) adding the remaining one-half of said amount of said precipitated amorphous silicate to said vat to produce said highly absorbent coating formulation.

2. A process for producing a highly absorbent coating formulation for facilitating multi-color printing onto a linerboard substrate having a basis weight greater than 150 g/m$^2$ as claimed in claim 1, wherein said coating formulation comprises:

i) 10–30% by weight precipitated amorphous silicate:

ii) 10–40% by weight titanium dioxide;

iii) up to 80% by weight calcium carbonate;

iv) up to 80% by weight clay;

v) up to 1% by weight hexametaphosphate; and vi) 10–40% by weight latex binder.

3. A process for producing a highly absorbent coating formulation for facilitating multi-color printing onto a linerboard substrate having a basis weight greater than 150 g/m$^2$ as claimed in claim 1, wherein said coating formulation comprises a total solids count of 58%.

4. A process for producing a highly absorbent coating formulation for facilitating multi-color printing onto a linerboard substrate having a basis weight greater than 150 g/m$^2$ as claimed in claim 1, wherein said latex binder is polyvinyl acetate.

5. A process for flexographically printing multi-color graphics onto a linerboard substrate having a basis weight of greater than 150 g/m$^2$ comprising the steps of:

a) coating onto said linerboard substrate a highly absorbent formulation comprising 10–30% by weight precipitated amorphous silicate; 10–40% titanium dioxide; up to 80% by weight calcium carbonate; up to 80% by weight clay; and a latex binder to form a coated linerboard; and b) flexographically printing in succession a plurality of inks onto said coated linerboard to form a multi-color printed substrate, wherein said inks are rapidly absorbed onto said coated linerboard to facilitate print uniformity and quality.

6. A process for flexographically printing multi-color graphics onto a linerboard substrate having a basis weight of greater than 150 g/m$^2$ as claimed in claim 5, further comprising the step of:

c) coating a layer of wax onto said printed substrate.

7. A process for flexographically printing multi-color graphics onto a linerboard substrate having a basis weight of greater than 150 g/m$^2$ as claimed in claim 5, wherein said coating formulation is produced by:

i) combining clay, calcium carbonate, titanium dioxide and an additive amount of hexametaphosphate in a vat to form a first mixture;

ii) adding one-half of an amount of a precipitated amorphous silicate, and a latex binder to said vat under shear stresses to form a second mixture; and iii) adding the remaining one-half of said amount of said precipitated amorphous silicate to said vat to produce said highly absorbent coating formulation.

8. A process for flexographically printing multi-color graphics onto a linerboard substrate having a basis weight of greater than 150 g/m$^2$ as claimed in claim 5, wherein said coating formulation has a thickness of 19.5–40.9 g/m$^2$.

9. A process for producing a highly absorbent coating formulation for facilitating multi-color printing onto a linerboard substrate having a basis weight greater than 150 g/m$^2$ comprising the steps of:

a) combining 5 parts by weight of clay, 55 parts by weight calcium carbonate, 20 parts by weight titanium dioxide, and an additive amount of hexametaphosphate in a vat to form a first mixture;

b) adding 10 parts by weight of a precipitated amorphous silicate and 23 parts by weight of a polyvinylacetate latex binder to said vat under high shear stress to form a second mixture; and c) adding the remaining 10 parts by weight of said required amount of said precipitated amorphous silicate to said vat to produce said highly absorbent coating formulation.

10. A process for producing a highly absorbent coating formulation for facilitating multi-color printing onto a linerboard substrate having a basis weight greater than 150 g/m$^2$ as claimed in claim 9 wherein said coating formulation comprises:

i) 15% by weight precipitated amorphous silicate;

ii) 15% by weight titanium dioxide:

iii) 47% by weight calcium carbonate;

iv) 4% by weight clay;

v) up to 1% by weight hexametaphosphate; and vi) 18% polyvinylacetate latex binder.

* * * * *